US006058981A

United States Patent [19]

Baumann et al.

[11] Patent Number: 6,058,981

[45] Date of Patent: May 9, 2000

[54] CLOTH TAKE-UP APPARATUS FOR A WEAVING MACHINE AND A WEAVING MACHINE WITH A CLOTH TAKE-UP APPARATUS

[75] Inventors: Heinz Baumann, Winterthur; Lucien Favey, Stäfa, both of Switzerland

[73] Assignee: Sulzer Rueti AG, Rueti, Switzerland

[21] Appl. No.: 09/251,590

[22] Filed: Feb. 17, 1999

[30] Foreign Application Priority Data

Feb. 19, 1998 [EP] European Pat. Off. ..... 98810135

[51] Int. Cl.[7] ..... D03D 49/20

[52] U.S. Cl. ..... 139/304

[58] Field of Search ..... 139/304, 307, 139/308

[56] References Cited

U.S. PATENT DOCUMENTS

| | | | |
|---|---|---|---|
| 2,293,666 | 8/1942 | Santon . | |
| 2,776,677 | 1/1957 | Paquette | 139/304 |
| 3,910,319 | 10/1975 | Bassing et al. | 139/308 |
| 4,192,353 | 3/1980 | Hintsch | 139/307 |

FOREIGN PATENT DOCUMENTS

| | | |
|---|---|---|
| 0224850A1 | 6/1987 | European Pat. Off. . |
| 2325908 | 12/1974 | Germany . |
| 3833941A1 | 4/1989 | Germany . |
| 2012321A | 7/1979 | United Kingdom . |

*Primary Examiner*—Andy Falik
*Attorney, Agent, or Firm*—Townsend and Townsend and Crew LLP

[57] ABSTRACT

The cloth take-up apparatus comprises a driven cloth take-up roller, two deflection elements which are rotatably supported, with the clearance between the deflection elements being less than the diameter of the cloth take-up roller, and a pressing device having a pressing part extending substantially over the length of the cloth take-up roller. The pressing device has at least one positioning device with a toggle lever mechanism and a fixed abutment in order to displace the cloth take-up roller out of a rest position into a working position and to fix it in the latter. With the blocking, the maintenance of the pressing pressure in the operating position is ensured.

10 Claims, 2 Drawing Sheets

CLOTH TAKE-UP APPARATUS FOR A WEAVING MACHINE AND A WEAVING MACHINE WITH A CLOTH TAKE-UP APPARATUS

The invention relates to a cloth take-up apparatus for a weaving machine, in particular a broad loom.

DESCRIPTION OF THE PRIOR ART

A cloth take-up apparatus of this kind is known from EP-A-0 224 850. This apparatus contains a pneumatic device with a pressure hose which is arranged beneath the pressing part and can be stressed with compressed air in order to press the cloth take-up roller against the deflection elements.

Furthermore, cloth take-up apparatuses are known in which the pressing is done by means of a mechanical device.

In weaving machines for the manufacture of high density and heavy technical fabrics in which extremely high pulling tensions are required in the web to achieve the specified cloth quality features, these cloth take-up apparatuses do not satisfy the requirements because the holding force must be produced by the positioning device in the above named embodiments.

The object of the invention is to improve a cloth take-up apparatus of the initially named kind.

This object is satisfied by providing a cloth take-up apparatus for a weaving machine that includes a pressing device having at least one positioning device with a toggle lever and a fixed abutment in order to displace a cloth take-up roller out of a rest position into a working position and to fix it in the working position.

The advantages of the invention are to be seen substantially in the simple construction and in the ensuring of the press-on pressure in the operating position.

It is advantageous when the pressing device has a plurality of positioning devices so that the diameter of the take-up roller and also the length X of the cloth table can be reduced as a result of the multiple support.

A weaving machine with an apparatus of this kind is characterised in accordance with the invention by the features of claim 8.

Advantageous embodiments of the invention result from the subordinate claims.

The invention will be explained in the following with reference to accompanying drawings.

DETAILED DESCRIPTION OF THE PREFERRED EXEMPLARY EMBODIMENTS

Figure 1:
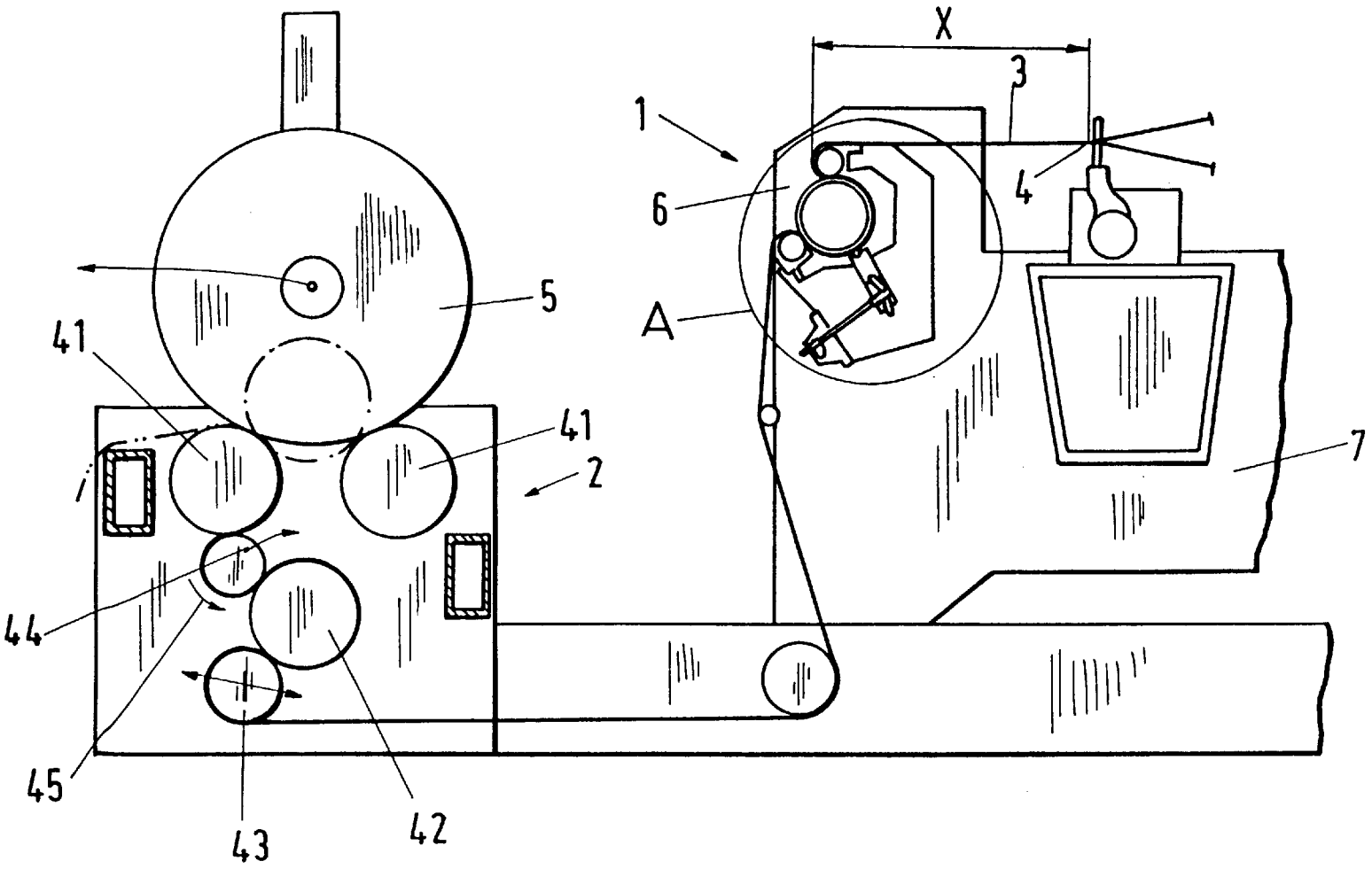
FIG. 1 is a section of a weaving machine with a cloth take-up apparatus in accordance with the invention and a cloth roll-up apparatus.

FIG. 1 shows a section of a weaving machine with a cloth take-up apparatus 1 and a cloth roll-up apparatus 2 which is equipped with a full cloth beam 5. The path of the cloth 3 from the beat-up edge 4 to the cloth beam 5 can be seen in this figure. The cloth take-up apparatus is arranged in bearing shields or housings 6. The bearing shields are fastened to the housing 7 of the weaving machine at equal distances, with the number of bearing shields depending on the web width. The dimension "X" designates the length of the so-called cloth table.

Figure 3:
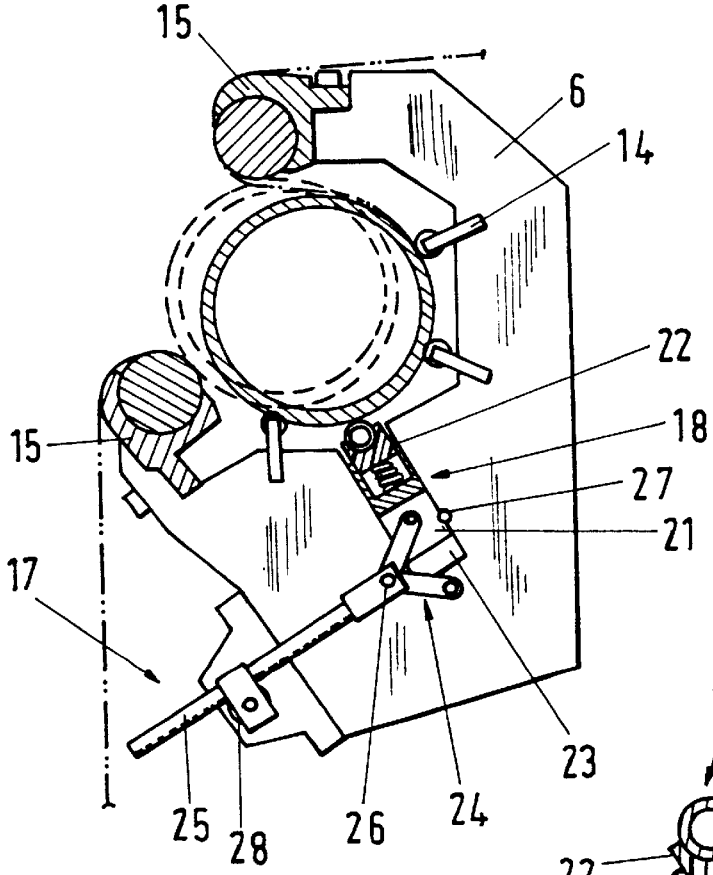
FIG. 3 is a view similar to that of FIG. 2 is, with the cloth take-up roller assuming the rest position
Figure 2:
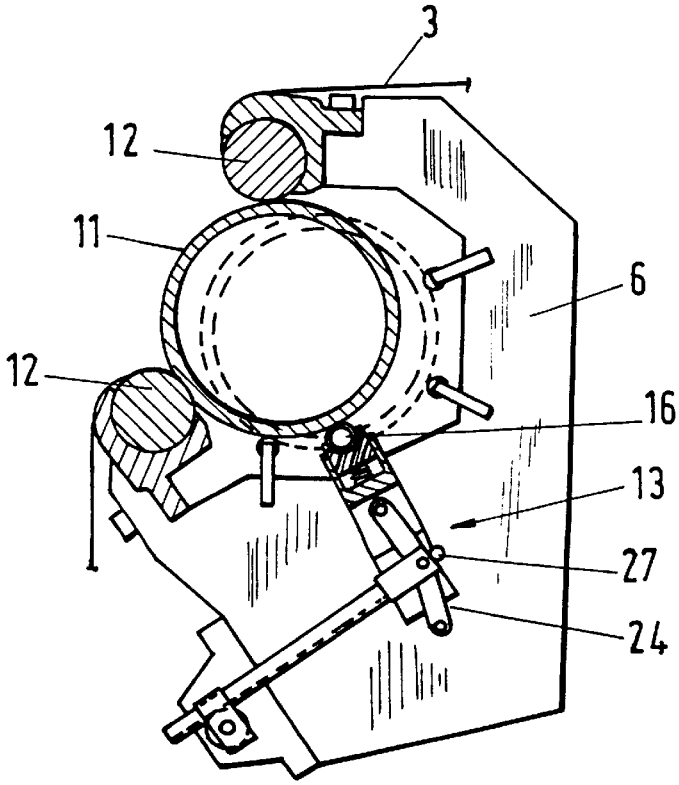
FIG. 2 is a detail A in FIG. 1 on a larger scale, with the cloth take-up roller assuming the operating position.

As shown in FIGS. 2 and 3, the cloth take-up apparatus 1 consists substantially of a driven cloth take-up roller 11, two deflection rollers 12 and a pressing device 13. When the cloth is not taut or when being covered with cloth the cloth take-up roller 11 is supported in the bearing shield 6 on auxiliary support rollers 14, with these support rollers being arranged only in the region of the roller ends which are not enveloped by the cloth. The deflection rollers 12 are journalled in bearing parts 15 which are arranged at the bearing shield. The bearing locations are arranged in such a manner that the clearance between the deflection rollers 12 is less than the diameter of the cloth take-up roller 11.

Figure 4:
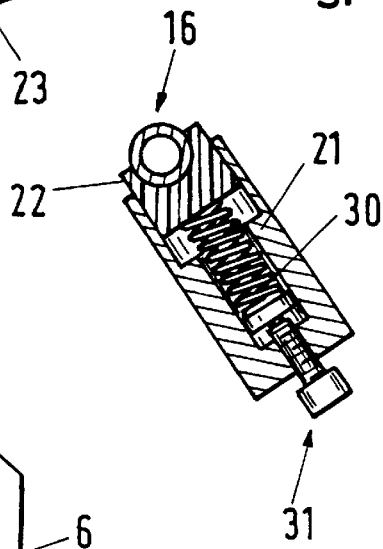
FIG. 4 is an embodiment of an arrangement for the support of the pressing part in section.

The pressing device 13 contains a pressing part 16 which extends substantially over the length of the cloth take-up roller (FIG. 4) and at least one positioning device 17 in order to displace the cloth take-up roller into an operating position so that the cloth take-up roller 11 lies up against the deflection rollers 12 when the cloth 3 is placed between them. The positioning device 17 is mounted on the bearing shield 6 and comprises an arrangement 18 which is displaceably arranged in a cut-out 23 in the bearing shield 6 and on which the pressing part 16 is rotatably arranged. The arrangement 18 contains a holder 21, a support part 22, which is resiliently supported in the holder 21, a toggle lever mechanism (or over-center mechanism) 24 which is pivotally connected at the one end to the holder 21 and at the other end to a fixed position on the bearing shield 6, a toothed bar or rack 25 which is connected to the joint 26 of the toggle lever mechanism and a fixed abutment, e.g. a bolt 27. The toothed bar 25 is in engagement with a gear 28 which is a constituent of a drive apparatus. As shown in FIG. 4, the support part 22 is supported on a spring 30 and a means 31 for adjusting the spring force is provided. For the variation of the spring force the springs can also be replaced or the number of springs employed can be changed.

For the displacement of the cloth take-up roller the toothed bar 25 is displaced by means of the drive apparatus and the toggle lever mechanism 24 is thereby laid against the bolt 27. In this position, there is a blocking, with the toothed bar being relieved.

The described embodiment of the cloth take-up apparatus with a plurality of bearing shields distributed over the width of the web enables, on the one hand, small roller diameters in spite of the large drawing force. On the other hand, a short cloth table "X" comparable with weaving machines of normal web widths results from this compact construction.

The cloth take-up apparatus illustrated in FIG. 1 has two support rollers 41 and an intermediate roller 42 which are respectively coupled to a non-illustrated drive and a first deflection roller 43 which is arranged on a plane falling off in the direction of travel of the cloth and a second deflection roller 44 which lies freely on the path of the cloth and, through the pull of the cloth, comes to lie against the support roller 41 and the intermediate roller 42 and which lies on a support shell 45 when the cloth tension lets up.

With the above-described cloth take-up apparatus, the tension in the cloth is maintained during the operation of the weaving machine and a change of the cloth beam is also enabled without stopping the weaving machine. During the operation of the weaving machine the first deflection roller 43 is pulled against the driven intermediate roller 42 as a result of the tension exerted by the cloth. The required cloth drawing tension is produced in this by means of a suitable control of the speed of rotation of the cloth take-up roller 11 and the intermediate roller 42. At the same time, the second deflection beam 44 is pressed by means of the enveloping cloth against the intermediate roller 42 and a supporting roller 41 by means of the enveloping cloth.

This arrangement thus enables the severing of the cloth at the winding side and the removal of the cloth beam without stopping the weaving machine. The finished cloth can thus also be conveyed away slack when required, and no interruption of the operation results during the winding on of an empty winding core.

The cloth take-up apparatus comprises a driven cloth take-up roller 11, two deflection elements 12 which are rotatably supported, with the clearance between the deflection elements being less than the diameter of the cloth take-up roller, and a pressing device 13 having a pressing part 16 extending substantially over the length of the cloth take-up roller. The pressing device 13 has at least one positioning device 17 with a toggle lever mechanism 24 and a fixed abutment 27 in order to displace the cloth take-up roller 11 out of a rest position into a working position and to fix it in the latter.

With the blocking, the maintenance of the pressing pressure in the operating position is ensured.

What is claimed is:

1. A cloth take-up apparatus for a weaving machine that includes a driven cloth take-up roller that is arranged moveably transverse with respect to its axis direction, the apparatus comprising respective deflection elements that are respectively placed before and after the cloth take-up roller and are rotatably supported, with the clearance between the deflection elements being less than the diameter of the cloth take-up roller, and a pressing device acting on the periphery of the cloth take-up roller and having a pressing part extending substantially over the length of the cloth take-up roller, wherein the pressing device has at least one positioning device with a toggle lever mechanism and a fixed abutment in order to displace the cloth take-up roller out of a rest position into a working position and to fix it in the working position.

2. An apparatus in accordance with claim 1 wherein the pressing device has a plurality of positioning devices.

3. An apparatus in accordance with claim 2 wherein the plurality of positioning devices are adjustable in common.

4. An apparatus in accordance with claim 1 wherein the toggle lever mechanism is arranged at one end at a fixed location, and wherein an abutment member serves as the fixed abutment.

5. An apparatus in accordance with claim 1 wherein the positioning device contains an actuation member that is connected to a joint of the toggle lever mechanism.

6. An apparatus in accordance with claim 1 wherein the pressing device contains a holder that is pivotally connected to the toggle lever mechanism and is displaceably arranged, and a support part that is resiliently supported in the holder and on which the pressing part is supported.

7. An apparatus in accordance with claim 6 wherein a resiliently elastic element is arranged between the support part and the holder.

8. An apparatus in accordance with claim 7 further comprising means for setting a spring force.

9. A weaving machine comprising a cloth roll-up apparatus that comprises a first deflection roller and a second deflection roller in order to maintain drawing tension and pressing of cloth and to be able to change a cloth beam without interrupting operation, the weaving machine further comprising a driven cloth take-up roller that is arranged moveably transverse with respect to its axis direction and a cloth take-up apparatus that comprises respective deflection elements that are respectively placed before and after the cloth take-up roller and are rotatably supported, with the clearance between the deflection elements being less than the diameter of the cloth take-up roller, and a pressing device acting on the periphery of the cloth take-up roller and having a pressing part extending substantially over the length of the cloth take-up roller, wherein the pressing device has at least one positioning device with a toggle lever mechanism and a fixed abutment in order to displace the cloth take-up roller out of a rest position into a working position and to fix it in the working position.

10. A weaving machine in accordance with claim 9 wherein the weaving machine is a broad loom.

* * * * *